United States Patent [19]

Rozas

[11] 4,383,776

[45] May 17, 1983

[54] TYPEWRITER WITH CARRIAGE ESCAPE BAR ADJUSTMENT

[76] Inventor: Luis A. V. Rozas, Jiron Puno 264, Lima 1, Peru

[21] Appl. No.: 224,828

[22] Filed: Jan. 13, 1981

[51] Int. Cl.[3] ..... B41J 19/16; B41J 19/60

[52] U.S. Cl. ..... 400/304; 400/303

[58] Field of Search ..... 400/303, 308, 304, 328.1, 400/332.6

[56] References Cited

U.S. PATENT DOCUMENTS

| | | | |
|---|---|---|---|
| 2,215,119 | 9/1940 | Fonenko | 400/303 |
| 2,544,998 | 3/1951 | Kissell | 400/304 |
| 2,582,372 | 1/1952 | Clarkson | 400/303 |
| 3,098,434 | 7/1963 | Lime | 101/248 |
| 3,163,109 | 12/1964 | Stelling, Jr. | 101/248 |
| 3,333,668 | 8/1967 | Sansele | 404/303 |
| 3,893,561 | 7/1975 | Gibbons et al. | 400/303 |

FOREIGN PATENT DOCUMENTS

| | | | |
|---|---|---|---|
| 415196 | 7/1925 | Fed. Rep. of Germany | 400/304 |
| 405018 | 12/1909 | France | 400/332.6 |

*Primary Examiner*—William Pieprz

*Attorney, Agent, or Firm*—Harvey B. Jacobson

[57] ABSTRACT

A business machine including a frame, a paper support mechanism and a printing mechanism for successive character printing on paper supported from the paper support mechanism is provided. One of the mechanisms is supported from the frame for guided incremented shifting relative to the other mechanism whereby successive printed characters made on paper supported from the paper support mechanism by the printing mechanism will form a line of printed characters extending along the paper in a predetermined path. An incremental advance structure including first and second indexing components supported from the frame and the aforementioned one mechanism is also provided and is operatively connected between the frame and the aforementioned one mechanism for advancing the latter to successive predetermined incremental positions of movement along the aforementioned path responsive to successive actuation of the printing mechanism and with such incremental positions of movement corresponding to predetermined positions on the paper support mechanism. Adjustment structure is provided supporting the first indexing component from the frame for infinite variable positioning relative thereto in a direction generally paralleling the aforementioned path. The adjustment structure includes a threaded connection between the first indexing component and the frame whereby the precise desired positioning of the first indexing component relative to the frame may be effected.

2 Claims, 7 Drawing Figures

TYPEWRITER WITH CARRIAGE ESCAPE BAR ADJUSTMENT

BACKGROUND OF THE INVENTION

Various forms of business machines, and particularly manual and electric typewriters, heretofore have been provided and used for printing (typing) business letters and forms. However, business machines of this type, after a paper to be printed upon has been inserted in the machine, are capable of printing characters only in predetermined positions spaced across the associated paper. Accordingly, if it is desired to print (type) a character or characters in positions other than those predetermined positions, it is necessary to loosen the paper from the paper support mechanism, shift the paper relative to the paper support mechanism to the desired position and thereafter again secure the paper in the shifted position thereof relative to the paper support mechanism. This shifting of the paper relative to the paper support mechanism is, at best, a trial and error method.

Accordingly, a need exists for a business machine paper support structure including means whereby the paper support structure may be precisely shifted, as desired, relative to the escape mechanism of the business machine which normally functions to successively position the paper support mechanism in predetermined positions relative to the printing mechanism.

Various forms of printing mechanisms including some of the general structural and operational features of the incident invention heretofore have been provided in U.S. Pat. Nos. 2,741,355; 3,448,844 and 3,819,028. However, these previously known forms of printing mechanisms are not well suited for the particular purpose for which applicant's invention has been designed and are not readily adaptable to existing business printing machines such as typewriters.

BRIEF DESCRIPTION OF THE INVENTION

The typewriter of the instant invention includes the usual carriage and escapement bar along which the carriage is movable through the utilization of a conventional escapement mechanism, whereby the carriage may be spaced in predetermined positions along the length of the escapement bar relative to the frame of the typewriter. However, the escapement bar of the typewriter of the instant invention is supported from the frame thereof for infinite longitudinal adjustable shifting relative to the typewriter frame and, therefore, the carriage of the typewriter, which may be disposed in predetermined positions longitudinally of the escapement bar, may have those predetermined longitudinally spaced positions slightly longitudinally shifted relative to the frame from which the escapement bar is supported for infinite longitudinal adjustment.

The main object of this invention is to provide a typewriter including structure whereby all of the predetermined spaces of the carriage of the typewriter transversely of the frame may be simultaneously infinitely adjusted transversely of the typewriter.

Another object of this invention is to provide a mechanism in accordance with the preceding objects and which may be readily operated.

Still another object of this mechanism for this invention is to provide a typewriter including an escapement bar adjustment which may be readily incorporated into the manufacture of manual and electrical typewriters presently being manufactured.

Still another important object of this invention is to provide an escapement bar adjustment for a typewriter or similar business machine which will enable the escapement adjustment to be changed in one direction for a short period of usage and then thereafter changed back to the original position of adjustment whenever desired.

A final object of this invention to be specifically enumerated herein is to provide a typewriter carriage escapement bar adjustment mechanism in accordance with the preceding objects and which will conform to conventional forms of manufacture, be of simply construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
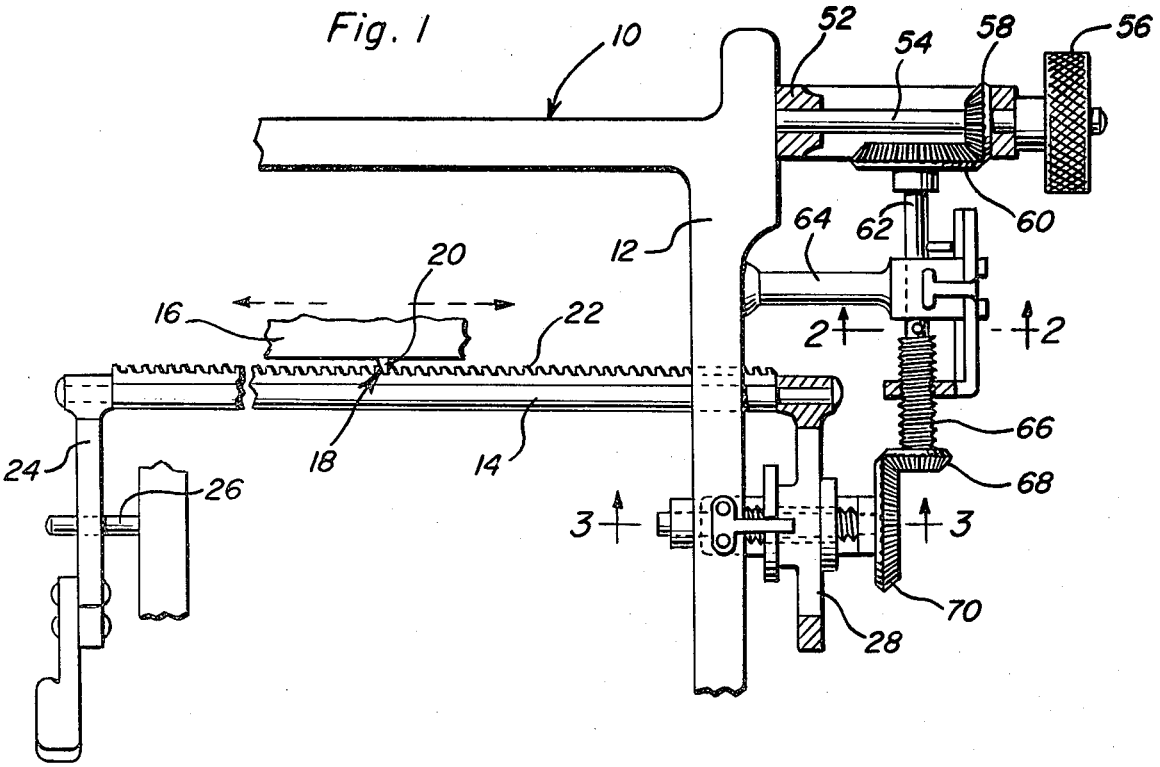
FIG. 1 is a fragmentary schematic view of the frame, escapement bar and carriage of a conventional form of manual typewriter and with the escapement bar adjustment structure of the instant invention operatively associated therewith, parts of the escapement bar adjustment structure being broken away and illustrated in vertical sections.
Figure 4:
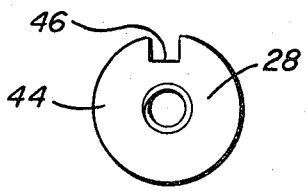
FIG. 4 is an end elevational view of the indexing structure supporting the right-hand end of the escapement bar illustrated in FIG. 1.
Figure 2:
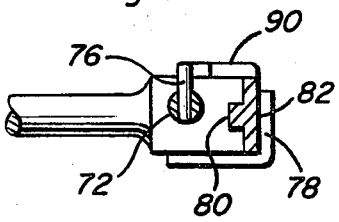
FIG. 2 is a fragmentary enlarged horizontal sectional view taken substantially upon the plane indicated by the section line 2—2 of FIG. 1.
Figure 3:
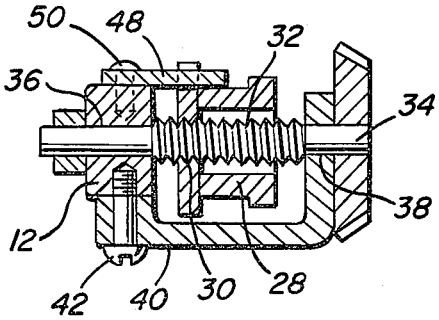
FIG. 3 is an enlarged horizontal sectional view taken substantially upon the plane indicated by the section line 3—3 of FIG. 1.
Figure 5:
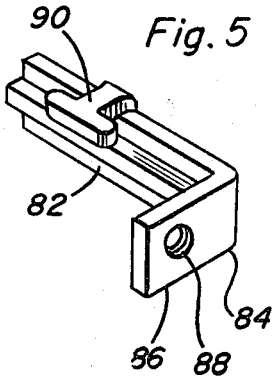
FIG. 5 is an enlarged perspective view of the stop-slide portion of the adjustment mechanism.
Figure 6:
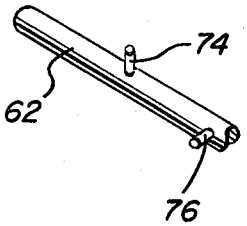
FIG. 6 is a fragmentary perspective view of the vertical shaft portion relative to which the stop-slide portion is shiftable in response to rotation of the vertical shaft portion.
Figure 7:
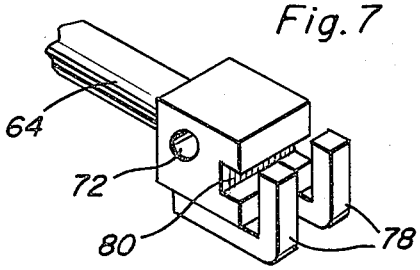
FIG. 7 is a fragmentary enlarged perspective view of the support for the stop-slide portion and vertical shaft portion.

Referring now more specifically to the drawings, the numeral 10 generally designates a conventional form of manual typewriter including a frame 12, a transverse escapement bar 14 supported from the frame 12 and a carriage 16 mounted on the frame for shifting longitudinally of the escapement bar 14 and having paper support structure including a platen (not shown) supported therefrom. The carriage 16 is conventionally supported from the frame 12 independent of the support of the escapement bar 14 from the frame 12, but the escapement bar 14 and carriage 16 include coacting escapement mechanism 18 consisting of an escapement tooth 20 shiftably supported from the carriage 16 and escapement bar teeth 22 spaced longitudinally along the escapement bar 14 and with which the shiftable escapement tooth 20 is successively enageable in response to successive actuation of the printing mechanism (not shown) of the typewriter 10 or the spacing mechanism of the typewriter 10.

The escapement bar 14 is supported at one end from a bracket or lever 24 slidable on a pin 26 supported from the frame 12 and at the other end from a follower 28. The follower 28 includes a threaded bore 30 formed therethrough in which the threaded portion 32 of a shaft 34 is threaded. One end of the shaft 34 is journaled through a bore 36 formed in the frame 12 and the other end of the shaft 34 is journaled in a bore 38 formed in a bracket 40 attached to the frame 12 through the utilization of suitable fasteners 42.

The follower 28 includes a disc-shaped end portion 44 having a peripheral axially extending notch 46 formed therein and the notch 46 slidably receive the free end portion of an index finger 48 therein, the other base end of the index finger 48 being supported from the frame 12 by a fastener 50. Accordingly, the follower 28 may not rotate about the axis of rotation of the shaft 34 but may merely shift longitudinally of the shaft 34 responsive to rotation of the shaft 34.

A mounting bracket 52 is supported from the frame 12 and rotatably journals a control shaft 54 therefrom having a control knob 56 mounted on the outer end thereof. The control shaft 54 has a bevelled gear 58 mounted thereon meshed with a second bevelled gear 60 carried by the upper end of an intermediate shaft 62 journalled from a bracket 64 mounted on the frame 12. The lower end portion of the intermediate shaft 62 is diametrically enlarged and threaded as at 66 and includes a bevelled gear 68 mounted on its lower terminal end for rotation therewith, the bevelled gear 68 being meshed with a fourth bevelled gear 70 carried on the end of the shaft 34 outwardly of the bore 38. Accordingly, rotation of the control knob 56 in turn causes rotation of the intermediate shaft 62 and also the shaft 34 whereupon the follower 28 is shifted longitudinally of the shaft and thereby effects longitudinal shifting of the escapement bar 14 and carriage 16.

The bracket 64 includes a bore 72 formed therethrough in which the intermediate shaft 62 is journaled and the shaft 62 includes longitudinally spaced radially outwardly projecting stop pins 74 and 76 supported therefrom. The bracket 64, which journals the intermediate shaft 62, includes a pair of L-shaped arms 78 supported therefrom which, together with a groove 80 formed in the bracket 64, define a guideway in which to slidingly receive the long leg 82 of an L-shaped slide portion 84 including a short leg 86 having a threaded bore 88 formed therein. The threaded portion 66 of the intermediate shaft 62 is threadedly received through the threaded bore 88 and, accordingly, upon rotation of the shaft 62 in opposite directions the slide portion 84 will move up and down the guideway defined by the arms 78 and groove 80. The slide portion 84 includes an outwardly projecting T-shaped arm 90 with which the pins 74 and 76 are alternately engageable in order to limit rotation of the intermediate shaft 62 in opposite directions and thereby limit longitudinal shifting of the escapement bar 14. Accordingly, depending upon the axial spacing of the pins 74 and 76 along the intermediate shaft 62, longitudinal shifting of the escapement bar 14 may be limited to any portion of the spacing between adjacent teeth 22 or the spacing between a number of teeth 22.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An adjustment mechanism for the carriage of a typewriter having an escapement bar and a frame with the escapement bar stationarily mounted on said frame and with the typewriter including a paper supporting carriage shiftably supported from the frame of the typewriter for incremental movement along the escapement bar, mounting means mounting said escapement bar from said frame for infinite longitudinal shifting of said bar relative to said frame, said mounting means including first, second and third brackets stationarily mounted on said frame, a control shaft journalled from said first bracket and having a control knob supported on one end thereof, an operator shaft journalled from said third bracket for rotation about an axis paralleling the path of shifting movement of said bar relative to said frame and having a threaded portion thereon, a follower arm dispoed generally normal to said operator shaft and includng a first end laterally through which said threaded portion of said operator shaft is threaded, the second end portion of said follower arm being anchored to said bar for longitudinal shifting of the bar responsive to lateral shifting of said follower arm along said threaded portion, an intermediate shaft journalled from said second bracket and disposed transverse to said control and operator shafts, the opposite ends of said intermediate shaft and said control and operator shafts having meshed beveled gears mounted thereon whereby angular displacement of said control knob on said control shaft will in turn cause angular displacement of said intermediate shaft and said operator shaft, lateral displacement of said follower arm and longitudinal shifting of said escapement bar relative to said frame, said frame and follower arm including coacting slidably engaged guide structure guiding said follower arm from said frame for lateral shifting relative thereto and against angular displacement of said arm with said operator shaft relative to said frame.

2. The adjustment mechanism of claim 1 wherein said intermediate shaft includes a threaded portion, a slide slidably mounted on said second bracket for movement along a path generally paralleling said intermediate shaft and including a portion thereof through which the threaded portion of said intermediate shaft is threadedly engaged, longitudinally spaced portions of said intermediate shaft having radially outwardly projecting abutment means thereon, said slide including a stop member thereon disposed between said abutment means and with which the latter are engageable upon shifting of said slide relative to said second bracket as result of rotation of said intermediate shaft in order to limit rotation of said intermediate shaft in opposite directions and thereby function to limit longitudinal shifting of said escapement bar relative to said frame.

* * * * *